United States Patent [19]

Teachout

[11] 4,188,871

[45] Feb. 19, 1980

[54] BAND AND CLIP METHOD

[76] Inventor: Donald O. Teachout, 1721 Bradford, N.E., Grand Rapids, Mich. 49505

[21] Appl. No.: 953,909

[22] Filed: Oct. 23, 1978

[51] Int. Cl.[2] ..... B65B 13/02

[52] U.S. Cl. ..... 100/2; 100/9; 24/16 R

[58] Field of Search ..... 100/2, 9; 53/399; 24/16 R, 17 R, 17 A, 17 B, 30.5 R, 30.5 P, 16 PB, 129 D, 255 R

[56] References Cited

U.S. PATENT DOCUMENTS

| | | | |
|---|---|---|---|
| 439,786 | 11/1890 | Low | 24/17 B |
| 2,953,827 | 9/1960 | Patterson | 24/16 PB |
| 3,119,160 | 1/1964 | Hoppeler | 24/16 R |
| 3,631,568 | 1/1972 | Wolfe | 24/16 R |
| 3,906,941 | 9/1975 | Cook | 24/30.5 P |

*Primary Examiner*—Billy J. Wilhite

*Attorney, Agent, or Firm*—Price, Heneveld, Huizenga & Cooper

[57] ABSTRACT

The specification discloses an article and method for banding objects. A clip is releasably secured to a common closed loop rubber band, thereby enabling one to wrap the band around objects to be banded together and slip the loop over the clip to hold it in place around the object. Alternative unique clips are disclosed.

13 Claims, 6 Drawing Figures

BAND AND CLIP METHOD

BACKGROUND OF THE INVENTION

The present invention relates to methods for banding objects together. The most common banding device is the popular rubber band. It is inexpensive and versatile. However, it is cumbersome to use for banding long objects together in that one has to slip the rubber band over the ends of the objects and slide it down the length. Also, it is more difficult to use where it has to be looped two or three times prior to slipping it over an object in order to hold the objects sufficiently securely.

Some have provided closed loop band members with fixedly or integrally attached buttons or heads such that the loop can be wrapped around articles and slipped over the head. However, securing the heads to the looped members appears to be a costly operation since such bands are relatively expensive. Also, prior art bands of this nature tend to be relatively expensive. Examples of such devices include U.S. Pat. Nos. 3,081,781, 2,953,827, 2,943,371, German Pat. No. 680,133, Swiss Pat. No. 133,395 and British Pat. No. 298,416.

Due to the specialized and expensive nature of such devices, the common, inexpensive rubber band is still a more popular banding device.

SUMMARY OF THE INVENTION

The present invention comprises a method and apparatus whereby a simple clip can be readily attached to or detached from a common, closed loop rubber band, enabling one to wrap the band around objects to be banded together one or more times and finally loop the looped end of the rubber band over the clip. The clip is wider at least in part than the rubber band so that the rubber band will engage the clip and be held in place.

Alternative novel clips are disclosed including a triangular shaped clip with a slot extending from an apex to a base thereof, a clip having a plate body with a slot therein such that the pliable body can be closed over a rubber band and placed in the slot, and a clip comprising a flat plate with a slot and a projection generally at the base of the slot such that the rubber band can be slipped over the projection, through the slot, around the objects to be banded and then back over the clip.

These and other objects, advantages and features of the present invention will be more fully understood and appreciated by reference to the written specification and appended drawings.

DESCRIPTION OF THE PREFERRED EMBODIMENT

Figure 1:
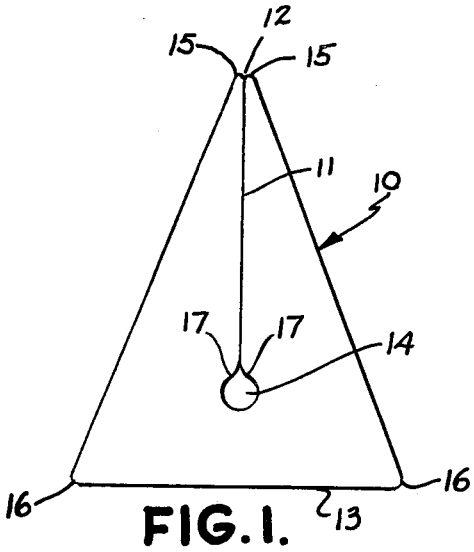
FIG. 1 discloses a triangular shaped clip made in accordance with the present invention.
Figure 2:
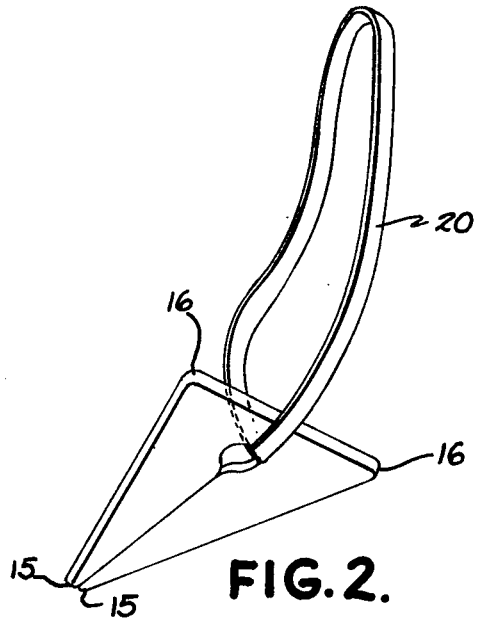
FIG. 2 shows the clip with a rubber band secured thereto.

The clip 10 shown in FIG. 1 comprises a generally flat, triangular shaped plate. It includes a slot 11 extending from the apex 12 thereof towards the base side 13. Slot 11 terminates short of base 13 at an enlarged aperture 14 which accommodates the width of most common rubber bands such as rubber band 20 (FIG. 2). The size of the clips could vary considerably, depending on the application (e.g. small, medium, and large).

Figure 3:
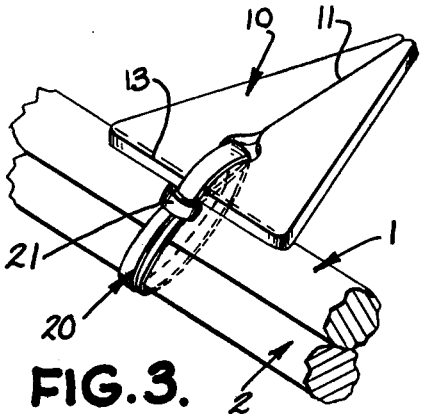
FIG. 3 shows the assembled clip and rubber band wrapped around two objects.

Clip 10 is preferably made of a somewhat flexible plastic material. The degree of flexibility varies widely. It should be at least sufficiently flexible that the portions on either side of slot 11 can be separated sufficiently to allow a rubber band 20 to be slipped into slot 11. Yet, it should be sufficiently rigid that when the rubber band is wrapped around objects such as 1 and 2 shown in FIG. 3, and the looped end slipped over clip 10, clip 10 will not collapse and allow the looped end to slip off of clip 10. Satisfactory plastics for the material include a relatively stiff rubber material, polypropylene plastics, polyethylene plastics, and other well known plastic materials.

Preferably, the apex 12 of the triangle is rounded at each point 15 on either side of slot 11. This makes it easier to slip rubber band 20 in place, These rounded edges 15 are especially useful when a stiffer plastic is used to make clip 10. When a stiff rubber band is used, the rounded points 15 are not as important.

Similarly, the corners 16 of base 13 are rounded to make clips 10 more comfortable to handle. This is not as necessary where the plastic material used is a stiff rubber.

Also, the edges 17 where slot 11 joins aperture 14 are preferably rounded. This facilitates removal of rubber band 20.

In use, one slips rubber band 20 into slot 11 and aperture 14. One holds one end of rubber band 20 in one hand and clip 10 in the other hand and wraps the band at least once around objects such as 1 and 2 which are to banded together. For a tighter wrap, one might wrap a rubber band around the object several times. When the wrap is sufficiently tight, one slips the looped end 21 of rubber band 20 over clip 10 and allows it to pull tight against some portion of clip 10 which is wider than rubber band 20, in this case the base 13 of triangular shaped clip 10.

Figure 4:
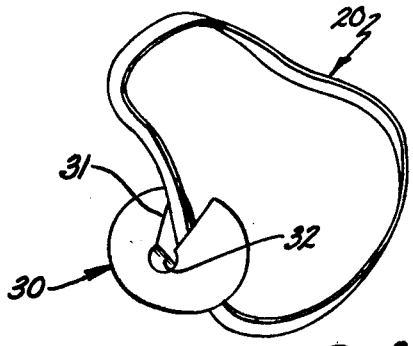
FIG. 4 discloses a rubber band being placed in an alternative embodiment clip.
Figure 5:
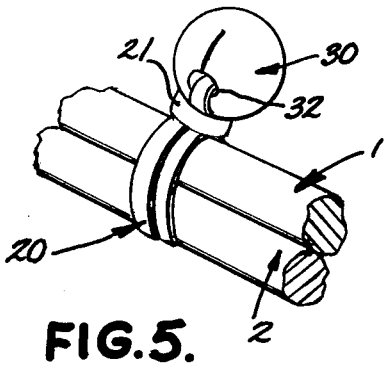
FIG. 5 discloses a rubber band and alternative embodiment clip assembly wrapped around two objects to be secured together.

The alternative embodiment clip 30 shown in FIG. 4 comprises a generally pliable material with a slot 31 cut therein, with a hole 32 at the base of the slot. One places rubber band 20 within slot 31 and down into hole or aperture 32 and then closes the opposite sides of slot 31 down tightly together. A suitable material for alternative embodiment clip 30 might be lead. In banding objects 1 and 2 together, the use of alternative embodiment clip 30 and a rubber band 20 is the same as that described for clip 10. (FIG. 5)

Figure 6:
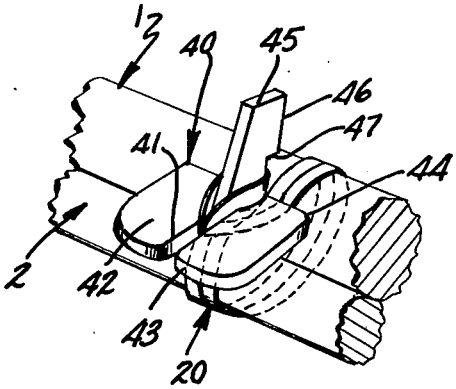
FIG. 6 discloses yet another alternative embodiment clip with a rubber band secured thereto and wrapped around objects to be banded together.

FIG. 6 discloses the objects 1 and 2 being banded together through the use of yet another alternative embodiment clip 40. Clip 40 comprises a plate 42 having a slot 41 extending from one side 43 thereof towards an opposite side 44. It includes a projection 45 projecting generally laterally out of the plane of plate 42. The side 46 of projection 45 which is opposite the base of slot 41 is generally sloped away from slot 41. This helps ensure that when a rubber band is slipped over projection 45, it will not slip off. Side 46 also deviates inwardly to define a shoulder 47. The rubber band 20 slips down behind shoulder 47 and thus one can be further assured that it will slip up off of projection 45 in use.

Alternative embodiment clip 40 can also be made of a plastic material. However, range of flexibility for the plastic is somewhat less than that of clip 10 in that it must be more rigid so that projection 45 will stand upright and not flop over easily. For this reason, it is preferable to cut slot 41 slightly wider than slot 11 since one may not be able to flex the opposite sides of clip 40 as wide as one can flex the opposite sides of clip 10.

In use, one slips rubber band 20 over projection 45 and snugs it up below shoulder 47. One then slips both sides of rubber band 20 through slot 41 and wraps them around the objects 1 and 2 to be secured together. Finally, the looped end of rubber band 20 is slipped over the top of clip 40 and comes to rest beneath the plate portion 42 thereof. Thus, it is hidden from view in FIG. 6.

Of course, it is understood that the above are merely preferred embodiments of the invention and that various changes and alterations can be made without departing from the spirit and broader aspects thereof, as defined in the appended claims which are to be interpretted in accordance with the prior art and the doctrine of equivalents.

The embodiments of the invention in which an exclusive property or privilege is claimed are defined as follows:

1. A method for banding objects together comprising: providing a clip and a closed loop rubber band, said clip having means for releasably securing it to said rubber band and including at least a portion wider than the width of said rubber band; securing said clip to said rubber band; wrapping the rubber band around objects to be banded and slipping said clip through the loop of the rubber band allowing the loop to come to rest against said clip whereby said rubber band securely bands together the objects around which it is wrapped.

2. The method of claim 1 in which providing said releasable securing means includes providing a slot in said clip through which said rubber band passes.

3. The method of claim 2 which includes providing said clip with a triangular shaped plate like configuration, and making it of a plastic material, said slot extending from the apex of said triangle towards the base thereof whereby the base of said triangle provides a shoulder against which said rubber band rests when the looped end thereof is slipped over said triangular shaped clip.

4. The method of claim 3 which includes providing an enlargement in said clip at the base of said slot for accomodating the width of said rubber band when it is placed in said slot.

5. The method of claim 4 which includes rounding the apex of said clip at each point on either side of said slot.

6. The method of claim 5 which includes rounding the area of said clip at the juncture of said slot with said enlargement.

7. The method of claim 6 which includes rounding the corners of said clip at either end of the base of said clip.

8. The method of claim 2 in which providing said clip comprises providing said clip with a generally flat plate having opposed sides and a slot extending from one side towards the other thereof, and a projection projecting from the surface of said plate generally laterally from the plane thereof, from a point located generally between the end of said slot and the said other side of said plate; said step of releasably securing rubber band to said clip comprising looping said rubber band over said projection and pulling it through said slot.

9. The method of claim 8 in which providing said projection on said clip includes providing a side located away from the base of said slot, which side slopes upwardly and away from said slot.

10. The method of claim 9 which includes providing a shoulder on said side of said projection against which said rubber band comes to rest.

11. The method of claim 10 which includes providing an enlarged aperture at the base of said slot for receiving the width of said rubber band.

12. The method of claim 2 in which providing said clip includes providing said clip with a pliable body with said slot extending into said body whereby one can close said body over said rubber band to thereby secure said clip to said rubber band.

13. The method of claim 12 which includes providing an enlargement in said clip at the base of said slot for accomodating the width of said rubber band when it is placed in said slot.

* * * * *

UNITED STATES PATENT AND TRADEMARK OFFICE

CERTIFICATE OF CORRECTION

PATENT NO. : 4,188,871

DATED : February 19, 1980

INVENTOR(S) : Donald O. Teachout

It is certified that error appears in the above-identified patent and that said Letters Patent are hereby corrected as shown below:

Column 1, line 41:

"plate" should be --pliable--

Column 3, line 3:

After "will" insert --not--

Column 3, line 24,25:

"interpretted" should be --interpreted--

Column 4, line 6, claim 4:

"accomodating" should be --accommodating--

Column 4, line 45, claim 13:

"accomodating" should be --accommodating--

Signed and Sealed this

*First* Day of *July 1980*

[SEAL]

*Attest:*

SIDNEY A. DIAMOND

*Attesting Officer*

*Commissioner of Patents and Trademarks*